United States Patent [19]

Burmester et al.

[11] Patent Number: 4,486,493

[45] Date of Patent: Dec. 4, 1984

[54] CUSHION BODY

[75] Inventors: Holger Burmester, Auggen; Klaus Veeser, Müllheim, both of Fed. Rep. of Germany

[73] Assignee: Firma Carl Freudenberg, Weinheim/Bergstrasse, Fed. Rep. of Germany

[21] Appl. No.: 470,323

[22] Filed: Feb. 28, 1983

[30] Foreign Application Priority Data

May 28, 1982 [DE] Fed. Rep. of Germany ..... 3220088

[51] Int. Cl.[3] ..... B32B 7/00

[52] U.S. Cl. ..... 428/253; 5/481; 294/DIG. 1; 428/233; 428/254; 428/256; 428/263; 428/360; 428/362; 428/373; 428/248

[58] Field of Search ..... 428/233, 236, 248, 252, 428/253, 257, 254, 282, 284, 287, 255, 256, 298, 299, 300, 301, 302, 360, 362, 373, 263; 5/481; 297/DIG. 1

[56] References Cited

U.S. PATENT DOCUMENTS

| | | | |
|---|---|---|---|
| 2,784,132 | 3/1957 | Maisil | 428/362 |
| 2,972,554 | 2/1961 | Muskat et al. | 428/360 |
| 3,454,422 | 7/1969 | Mead et al. | 428/362 |
| 4,042,737 | 8/1977 | Forsgren et al. | 428/253 |
| 4,443,903 | 4/1984 | Leitner | 428/248 |
| 4,454,178 | 6/1984 | Naarmann et al. | 428/254 |
| 4,454,191 | 6/1984 | Blücher et al. | 428/248 |

*Primary Examiner*—James J. Bell

*Attorney, Agent, or Firm*—Kenyon & Kenyon

[57] ABSTRACT

The invention of this application relates to a cushion body, well suited for use as a seat cushion of a motor vehicle, consisting of a spring body which is deformable under a load, and is air and mositure permeable. The cushion also employs an air permeable cover material which is stretched over the cushion and is underlaid with a buffer layer which has a substantial content of cellulose fibers. The spring body consists of fibers with hydrophilic properties and a titer of 3 to 50 dtex, which fibers are combined to form a spatially oriented network, and are cemented together where they intersect.

11 Claims, 1 Drawing Figure

CUSHION BODY

BACKGROUND OF THE INVENTION

This invention relates to a cushion body, especially a seat cushion for a motor vehicle, consisting of a spring body which is deformable and at the same time air and moisture permeable in the loaded condition, as well as a buffer layer which has a substantial content of cellulose fibers, and is located intermediate the spring body and an air-permeable cover material. The cover material is stretched over the cushion body.

DE-GM No. 75 03 063 discloses a cushion body, which is stated to be suitable for use as a seat cushion for a motor vehicle. The spring body disclosed by that reference consists of a foam material block which has continuous openings, and is enclosed in a multilayer cover. The openings in the foam block serve to improve the air circulation in the foam block, and thereby to discharge moisture. This effect is aided by the cover material, which includes a layer of cellulose fibers, and is capable of absorbing accumulated moisture without becoming saturated. If a substantial amount of moisture is going to be accumulated during use, however, an absorbent layer of considerable thickness is required to absorb the excess moisture, and a long drying time between individual periods of use will be required. This is true because the relative size of the exchange surfaces bounding the openings in the foam block are too small relative to the area of the cover material, and because the volume of air contained in the pores of the foam block is renewed too slowly. Cushion bodies of this type are therefore considered only conditionally suitable for extended use.

It is an object of the present invention to provide a cushion body which is free of the disadvantages mentioned above, and which can be used without interruption, and without the danger that during use partial areas will occur on the cushion which feel wet.

BRIEF DESCRIPTION OF THE INVENTION

In accordance with the foregoing objectives, the cushion body of this invention employs a spring body consisting of fibers with hydrophilic properties, and a titer of about 3 to about 50 dtex, which fibers are combined to form a spatially oriented network, and are cemented together where the fibers intersect. When the spring body is comprised of natural and/or synthetic fibers, the spring body may have a thickness of about 5 to about 20 mm and a bulk weight of about 10 to about 100 kg/m$^3$. A buffer layer having an area weight of about 150 g/m$^2$ to about 350 g/m$^2$ is disposed intermediate an air permeable surface covering for the cushion body and the spring body.

BRIEF DESCRIPTION OF THE FIGURE

This invention will be described in detail with reference to appended FIG. I, which provides a cut-away view of the present cushion invention.

DETAILED DESCRIPTION OF THE INVENTION

Figure 1:
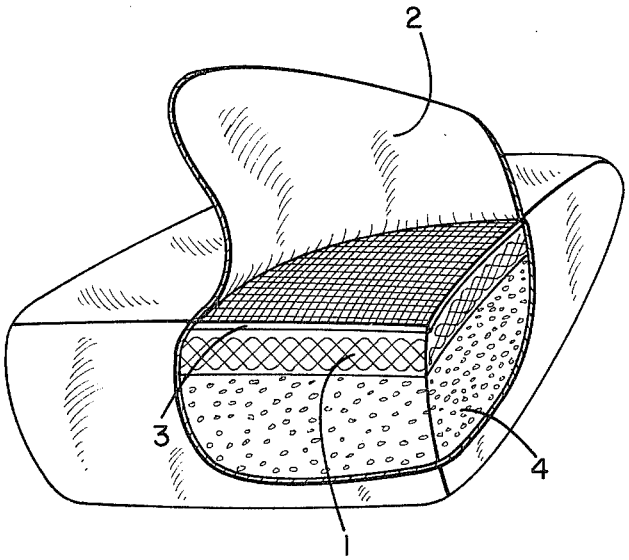

The spring body employed in the cushion body of this invention is very thin, for example, a thickness of only about 5 to about 20, or about 8 to about 15 mm. If natural and/or synthetic threads are used in the fabrication of the spring body, the preferred bulk weight of the spring body is about 50 kg/m$^3$.

The spring body consists of relatively coarse fibers with hydrophilic properties, which are combined to form a spatially oriented network, and are cemented together where the fibers of the fiber network intersect.

During use, local compression of the spring body preferably by about 20% to about 60% is obtained in the area of greatest load, and a corresponding reduction occurs in the volume of the hollow spaces defined by the fiber network of the spring body. Normally, during use, this volume reduction is not constant but changes depending on any change in the sitting position or, if the cushion body is used as a seat cushion in a motor vehicle, depending on any swing of the vehicle. Therefore, an airflow develops in between the interior zones of the fiber network which bear different loads. This airflow occurs parallel to the surface of the cushion. In addition, the airflow is continuously reversed, and the circulating air with the spring body contacts areas which are subjected to different degrees of moisture.

The spring body network consists of fibers with hydrophilic properties, which are in contact with a buffer layer of cellulose fibers and form, together with the latter, a closed unit with respect of the absorption and desorption properties.

More specifically, the moisture absorbed by portions of the buffer layer is transported into the hydrophilic fibers of the spring body network, before the buffer layer becomes saturated. Thereby, the moisture is distributed, in the process, over an exchange area which is several times larger than the moisture loaded area of the buffer layer. The moisture can thereby be absorbed more easily by the air flowing through the spring body network, and transported into regions of the spring body which are ess heavily loaded. There, the moisture is precipitated, preferably again in the hydrophilic fibers of the network, for eventual discharge into the buffer layer, and for evaporation over the surface of the cushion during use. There is no longer any danger of a moisture backup, even if moisture is loaded over an extended period of time, as the result of an unchanged sitting position.

The area weight of the buffer layer is about 150 to about 350 g/m$^2$. If the area weight of the buffer layer is lower than this, the result can be insufficient distribution of the moisture absorbed by the buffer layer to as many fibers of the spring body network as possible. If the area weight of the buffer layer is higher than about 150 to about 350 g/m$^2$, the result is unsatisfactory desorption behavior in the non-loaded areas if the cushion is loaded by a sitting person of average weight under extreme conditions, for instance, during a long automobile trip in summer. In such a case, a backup of moisture in the area of the loaded zone can occur.

The dry feel of the surface of the cushion can be aided by applying a layer of hydrophobic fibers on the surface of the buffer layer. This layer must be sufficiently air permeable, and must not impair the absorption and desorption behavior of the buffer layer to an appreciable degree. Woven and knitted materials, as well as velour and terry cloth materials with an area weight of about 100 to about 500 g/m$^2$ comprised of polypropylene and/or polyester fibers have proven themselves. However, any conventional cushion covering material can be used if the above-mentioned requirements are met.

The use properties of the cushion body depend substantially on the constant elasticity of the network. Natural fibers with a coarse titer can be used without difficulty. However, the use of synthetically produced fibers of hydrophobic materials which have a surface coating of a hydrophilic material is preferred. For the purpose of transporting the moisture from and into the buffer layer, only the cross-sectional area of the coating of hydrophilic material is available. However, the cross-sectional area is entirely sufficient in view of the multiplicity of the fibers combined in the network. Moreover, moisture exchange occurs between the hydrophilic surface of the fibers, the buffer layer and the passing air.

Contrary to cushions of the type described in DE-GM No. 7503063, practically the entire underside of the buffer layer of the cushion of this invention is available for moisture exchange between the flowing air and the buffer layer, and, additionally, the entire surface of each individual fiber of the spring body is also available for moisture exchange.

The hydrophobic fibers which comprise the spring body may consist of metal and/or of plastic. Among the metals, corrosion-resistant materials are preferred; particularly preferred are brass fibers and suitable grades of steel fibers. Of the plastics, those with low water absorption are preferred, particularly polypropylene and polyester. Moreover, preferably crinkled fibers are employed in order to provide an open structure, and good spring elasticity in the network. The number of crinkled arcs per centimeter may be about 5 to about 40. The fibers are durably cemented to each other, so that there is no danger that the bonds may come loose during use. Preferably, chemically cross-linked bonding agents are used, for instance, those bonding agents having a rubber or plastic base.

The spring body network may also be a textured fabric of at least one endless thread. Depending on the fixation and mutual relationship of the individual meshes, the air flowing through the network during use is canalized, and through the use of such a textured fabric, a particularly advantageous ventilation effect is obtained. On the other hand, embodiments in which the network consists of fibers combined in accordance with a nonwoven fabric technology have the advantage of better fiber separation and, therefore, improved moisture exchange.

The present invention will be illustrated further with reference to FIG. I, which discloses an embodiment of the present invention suitable for use as an automobile seat.

The shape of the automobile seat is essentially determined by the shape of the foam material body (4) which is substantially impervious to air and consists of a soft polyurethane foam with a bulk weight of about 35 kg/m$^3$.

The spring body (1) is connected to the topside of the foam material body (4). The spring body consists of a mixture of the fibers defined in detail as follows:

| Type of Fiber | Titer (dtex) | Staple Length mm | Crinkle (arcs/cm) | Content in Mixture |
|---|---|---|---|---|
| PES | 45 | 80 | 5 to 6 | 20% |
| PES | 22 | 50 | 5 to 6 | 60% |
| CV | 9 | 75 | smooth | 20% |

The fibers were intimately mixed, randomly deposited, and further densified by a needling process applied to the fabric obtained. Subsequently, impregnation with a hydrophilic bonding agent of the following composition was performed:

A mixture is prepared of:

1. An aqueous dispersion of a copolymerisate with a base of butadiene/acrylonitrile with self-crosslinking groups, 2. A Lewis acid, for instance, ammonium chloride as a catalyst for the crosslinking reaction, and 3. Emulsifiers in order to increase the hydrophilic action of the bonding agent film, for instance, polyethylene oxide siloxane.

The bonding agent was deposited as a continuous layer on the surface of the fibers of the fabric and, after drying and subsequent crosslinking, the bonding agent causes the fibers to be mutually cemented together at points of intersection. The weight percentage of bonding agent is 70%, and the thickness of the spring body is 15 mm with an area weight of 600 g/m$^2$.

A buffer layer of a fabric obtained by a wet process is applied to the top side of the spring body. The fiber mixture consists of a mixture of the following fibers:

| Type of Fiber | Titer (dtex) | Staple Length mm | Crinkle | Content in Mixture |
|---|---|---|---|---|
| CV | 17 | 18 | smooth | 20% |
| PES | 3.3 | 18 | smooth | 10% |
| PES | 6.8 | 12 | smooth | 10% |
| Cellulose | Pinewood sulfate bleach, with high alpha-cellulose content | | | 60% |

The fiber fabric, prepared from the mixture described above, is solidified with a bonding agent mixture which is composed of:

1. An aqueous dispersion of a copolymerisate with a base of butadiene/acrylonitrile with self-crosslinking groups, 2. A Lewis acid, for instance, ammonium chloride, and 3. Emulsifiers, for instance, polyethylene oxide siloxane.

After drying and subsequent crosslinking, this bonding agent causes the fibers to be cemented together. The weight content of the binding agent in the buffer layer is about 20%. The buffer layer has a thickness of 1.5 mm with an area weight of 250 g/m$^2$.

The cover material (2) may consist of a highly air-permeable knitted fabric of polyamide fibers, having, for example, an area weight of about 400 g/m$^2$. The cover layer is cut and sewed together in such a manner that the unit consisting of the foam material body, the spring body and the buffer layer is enclosed on all sides by the cover layer.

While specific embodiments of the invention have been described with particularity herein, it should be understood that this invention is intended to cover all changes and modifications of the embodiments of the invention chosen for purposes of illustration which do not constitute departures from the spirit and scope of the present invention.

We claim:

1. A cushion body, suitable for use as an automobile cushion, comprising a deformable spring body which is air and moisture permeable, an outermost air permeable surface covering, and disposed intermediate the spring body and outermost surface covering, a buffer layer, wherein the buffer layer has an area weight of about 150 to about 350 gm/m$^2$ and is comprised substantially of cellulose fibers, and wherein the spring body is comprised of a network of intersecting fibers which are bonded together at their points of intersection, and wherein the spring body has a bulk weight of about 10 to about 100 kg/m$^2$, a thickness of about 5 to about 20 mm, and the fibers which form the spring body have hydrophilic properties and a titer of about 3 to about 50 dtex.

2. The cushion body according to claim 1 wherein the fibers of said spring body are comprised of a core of a hydrophobic material surface coated with a hydrophilic material.

3. The cushion body according to claim 2 wherein the core material is formed from a plastic or metal.

4. The cushion body according to claim 3 wherein the fibers of said spring body are crinkled.

5. The cushion body according to claim 1 wherein the fibers of said spring body are crinkled.

6. The cushion body according to claim 4 wherein the crinkled fiber has about 5 to about 40 arcs per centimeter.

7. The cushion body according to claim 5 wherein said crinkled fibers have about 5 to about 40 arcs per centimeter.

8. The cushion body according to claim 1 wherein said fibers are bonded together by a crosslinkable bonding agent.

9. The cushion body according to claim 3 wherein the fibers are bonded together by a crosslinkable bonding agent.

10. The cushion body according to claim 1 wherein said network is a knitted fabric.

11. The cushion body according to claim 2 wherein said network is a knitted fabric.

* * * * *